US008281720B2

(12) United States Patent
Dindl et al.

(10) Patent No.: US 8,281,720 B2
(45) **Date of Patent: *Oct. 9, 2012**

(54) FLECHETTE CARTRIDGE

(76) Inventors: Frank J Dindl, Newton, NJ (US); Kenneth R Jones, Wayne, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/887,590

(22) Filed: Sep. 22, 2010

(65) Prior Publication Data

US 2011/0192311 A1 Aug. 11, 2011

Related U.S. Application Data

(62) Division of application No. 11/880,328, filed on Jul. 20, 2007, now Pat. No. 7,823,509.

(51) Int. Cl.
*F42B 14/06* (2006.01)

(52) U.S. Cl. ..... 102/438

(58) Field of Classification Search ..... 102/438, 102/520, 502, 504, 444, 498, 529; 244/3.24, 244/3.25, 3.26, 3.27, 3.3
See application file for complete search history.

(56) References Cited

U.S. PATENT DOCUMENTS

| | | | | | |
|---|---|---|---|---|---|
| 1,195,107 | A * | 8/1916 | Sheriff | 102/448 |
| 1,203,649 | A * | 11/1916 | Papuga | 102/456 |
| 3,599,568 | A * | 8/1971 | Shellnutt et al. | 102/455 |
| 3,954,060 | A * | 5/1976 | Haag et al. | 102/494 |
| 4,935,177 | A * | 6/1990 | Theising | 264/45.4 |
| 4,996,923 | A * | 3/1991 | Theising | 102/438 |
| 5,796,031 | A * | 8/1998 | Sigler | 102/520 |
| 2010/0212531 | A1 * | 8/2010 | Dindl et al. | 102/438 |

* cited by examiner

*Primary Examiner* — Bret Hayes
*Assistant Examiner* — Reginald Tillman, Jr.
(74) *Attorney, Agent, or Firm* — Townsend & Banta

(57) ABSTRACT

A flechette cartridge is provided, containing a plurality of flechettes, capable of firing the flechettes in a concentrated and accurate spread pattern upon firing. In particular, both low and high velocity flechette cartridges are provided, which accurately disperse flechettes in a concentrated spread pattern. The flechette cartridge minimizes the parasitic launch mass to maximize flechette payload, flechette velocity and kinetic energy, and to maximize target effects. The flechette cartridge provides a robust means for reliably stripping the flechette payload cup.

7 Claims, 6 Drawing Sheets

FLECHETTE CARTRIDGE

CROSS REFERENCE TO A RELATED APPLICATIONS

This is a divisional patent application of application Ser. No. 11/880,328 filed Jul. 20, 2007, now allowed.

FIELD OF THE INVENTION

The present invention provides a flechette cartridge having flechettes contained therein which, when fired, are accelerated without spin being imparted thereto. In particular, a flechette cartridge is provided containing flechettes which are accelerated within the cartridge case without spin imparted thereto, and which do not engage the barrel rifling, thus allowing flechettes to stabilize quickly and avoiding an excessive spread pattern during a firing event.

BACKGROUND OF THE INVENTION

Conventional flechette rounds, such as the M1001, contain approximately 113 flechettes, each flechette weighing 18 grains. The flechettes contained within such conventional rounds reach average velocities of approximately 790 ft/sec. Such velocities are satisfactory. The M1001 uses a heavy projectile body to carry the flechette payload down the barrel. The projectile body uses a slip band obturator to minimize spinning the projectile body and flechette payload in the barrel rifling.

Conventional payload carriers are stripped from the flechette payload by propellant gases and a spring, which are deficient in stripping the payload carriers from the flechette payloads. Further, the payload carrier is formed of a heavy metal body, which undesirably functions as a parasitic mass. This means of stripping the flechette payload carriers results in undesired dispersion characteristics. The relatively heavy metal body results in reduced muzzle velocities and reduced kinetic energy, reducing the effectiveness of the flechettes.

It is an object of the present invention to provide a flechette cartridge which maximizes the muzzle velocity of the flechettes by minimizing the parasitic mass associated with the flechette carrier. It is a further object of the present invention to provide a robust means for reliably stripping the flechette carrier.

SUMMARY OF THE INVENTION

In order to achieve the object of the present invention as described above, the present inventor earnestly endeavored to develop a flechette cartridge capable of launching flechettes in a concentrated, predictable spread pattern at a relatively high muzzle velocity. Accordingly, in a first embodiment of the present invention, a flechette cartridge is provided comprising:

(a) a cartridge case having:

(i) a base having a primer cavity disposed therethrough;

(ii) a cartridge case body having an outer circumference adjacent the base, and an inner circumference opposite the outer circumference, said inner circumference defining a smooth-bored cartridge barrel, the smooth-bored barrel having a open mouth at one end thereof;

(iv) a high pressure chamber disposed adjacent the primer cavity; and (v) a low pressure chamber disposed adjacent the high pressure chamber;

(b) a primer disposed within the primer cavity;

(c) a propellant charge disposed within the high pressure chamber;

(d) a sub caliber payload cup slidably disposed within the smooth-bored cartridge barrel, adjacent the low pressure chamber, the sub caliber payload cup having:

(i) a payload cup body having an outer base, an outer circumference adjacent the outer base, an inner circumference opposite the outer circumference, and an inner base opposite the outer base; and (ii) flechette retaining means for retaining flechettes, disposed within the inner circumference; and (iii) a plurality of flechettes retained within the flechette retaining means.

In a second embodiment of the present invention, the flechette cartridge of the first embodiment above is provided, wherein the payload cup body further comprises a metal disk disposed therein, within the inner circumference of the payload cup body, adjacent the inner base. This metal disk prevents the flechettes from digging into the payload cup body upon firing.

In a third embodiment of the present invention, the flechette cartridge of the first embodiment above is provided, wherein the payload cup further comprises a payload cup stripping means in communication with the cartridge case at a first end, and with the payload cup at an end opposite the first end, wherein, when the flechette cartridge is fired, the payload cup is propelled from the smooth bored cartridge barrel and, at a predetermined distance from the smooth bored cartridge barrel, the payload cup stripping means acts upon the payload cup to strip the payload cup from the flechettes. The flechette retaining means generally disintegrates upon being exposed to the high velocity airstream, allowing the flechettes to fly unimpeded to the target.

In a fourth embodiment of the present invention, the flechette cartridge of the third embodiment is provided, wherein the payload cup stripping means is comprised of a line or string.

In a fifth embodiment of the present invention, the flechette cartridge of the first embodiment above is provided, wherein a barrel ridge is formed on the smooth-bored cartridge barrel, and a payload cup ridge is formed on the payload cup, adjacent the outer base thereof. Upon firing, the payload cup ridge and barrel ridge are caused to impact one another, thereby decelerating the payload cup.

In a sixth embodiment of the present invention, the flechette cartridge of the first embodiment above is provided, comprising a plurality of sub caliber payload cups disposed within the smooth-bored barrel, with separator disks disposed therebetween.

In a seventh embodiment of the present invention, the flechette cartridge of the first embodiment above is provided, further comprising an ogive cap removably disposed on the cartridge case adjacent the open mouth of the smooth bored barrel.

In an eighth embodiment of the present invention, the flechette cartridge of the first embodiment above is provided, further comprising a metal disk disposed within the cartridge barrel between the low pressure chamber and the payload.

In a ninth embodiment of the present invention, the flechette cartridge of the first embodiment above is provided, wherein an empty volume is present within the cartridge barrel between the payload cup and the open mouth of the smooth-bored barrel. Longer cartridge barrel lengths allow for gentler payload accelerations, with lower required peak propellant pressures.

In a tenth embodiment of the present invention, the flechette cartridge of the first embodiment above is provided, further comprising a closure disk disposed within the cartridge barrel, adjacent the flechettes and flechette retaining means of the sub caliber payload cup.

In an eleventh embodiment of the present invention, the flechette cartridge of the first embodiment is provided, comprising a plurality of sub caliber payload cups.

In a twelfth embodiment of the present invention, a flechette cartridge is provided comprising:

(a) a cartridge case having:

(i) a base having a primer cavity disposed therethrough;

(ii) a cartridge case body having an outer circumference adjacent the base, and an inner circumference opposite the outer circumference, said inner circumference defining a smooth-bored cartridge barrel, the smooth-bored barrel having a open mouth at one end thereof;

(b) a primer disposed within the primer cavity;

(c) a propellant charge disposed within the cartridge case body;

(d) a sub caliber payload cup slidably disposed within the smooth-bored cartridge barrel, the sub caliber payload cup having:

(i) a payload cup body having an outer base, an outer circumference adjacent the outer base, an inner circumference opposite the outer circumference, and an inner base opposite the outer base; and (ii) flechette retaining means for retaining flechettes, disposed within the inner circumference; and (iii) a plurality of flechettes retained within the flechette retaining means.

DETAILED DESCRIPTION OF THE INVENTION

Figure 1:
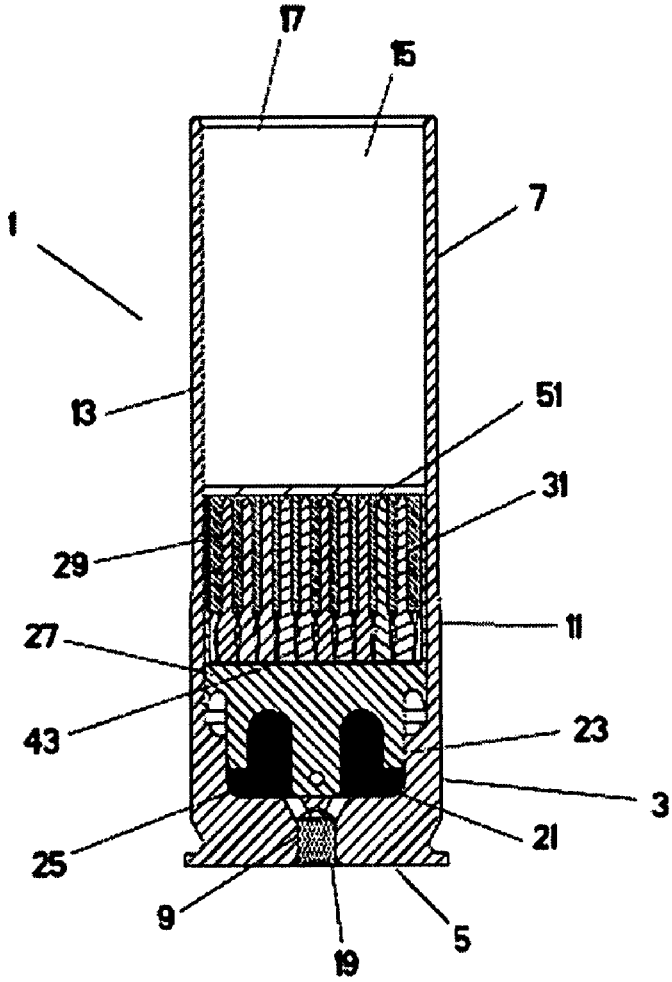
FIG. 1 is a cross sectional view of the flechette cartridge of the present invention.
Figure 2:
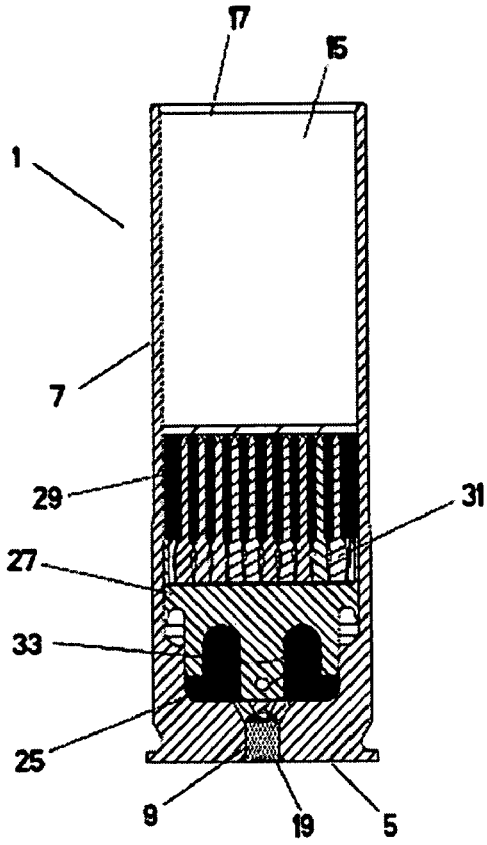
FIG. 2 is a cross-sectional view of the flechette cartridge of the present invention, as shown in FIG. 1, further illustrating the payload cup stripping means 33.

As illustrated in FIGS. 1 and 2, the present invention provides a flechette cartridge 1 comprising a cartridge case 3 having a base 5 and cartridge case body 7. A primer cavity 9 is disposed through said base 5. The cartridge case 3 is comprised of a cartridge case body 9 having an outer circumference 11 adjacent the base 5, and an inner circumference 13 opposite the outer circumference 11. The inner circumference 13 defines a smooth-bored cartridge barrel 15, the smooth-bored barrel 15 having an open mouth 17 disposed at one end thereof.

A primer 19 is disposed with the primer cavity 9, and high pressure chamber 21 is disposed adjacent the primer cavity 9. A low pressure chamber 23 is disposed adjacent the high pressure chamber 21. A propellant charge 25 is disposed within the high pressure chamber 21. When fired, the weapon firing pin strikes the primer 19, and the primer 19 ignites, subsequently igniting the propellant charge 25.

A sub caliber payload cup 27 is disposed within the smooth-bored cartridge barrel 15, adjacent the low pressure chamber 23. Alternatively, a single propellant chamber can be used, wherein the propellant is ignited and propels the payload cup down the barrel, venting at the muzzle. The sub caliber payload cup 27 is comprised of a flechette retaining means 29 for retaining flechettes, and for sealing propellant case within the cartridge barrel, and a plurality of flechettes 31 retained therein. The flechette retaining means 29 is, generally, formed of a plastic or composite material, but may be formed of a metallic material, and has a structure containing numerous protrusions therein for frictionally retaining the flechettes 31.

As called for in the eighth embodiment of the present invention herein, and as illustrated in FIG. 1, the low velocity flechette cartridge 1 may further comprise a metal disk 43 disposed within the smooth-bored cartridge barrel 15 between the low pressure chamber 23 and the sub caliber payload cup 27. This metal disk 43 acts to separate and evenly disperse the pressure produced by the propellant gases, so as to prevent damage to the flechettes and the flechette retaining means during firing.

Figure 5:
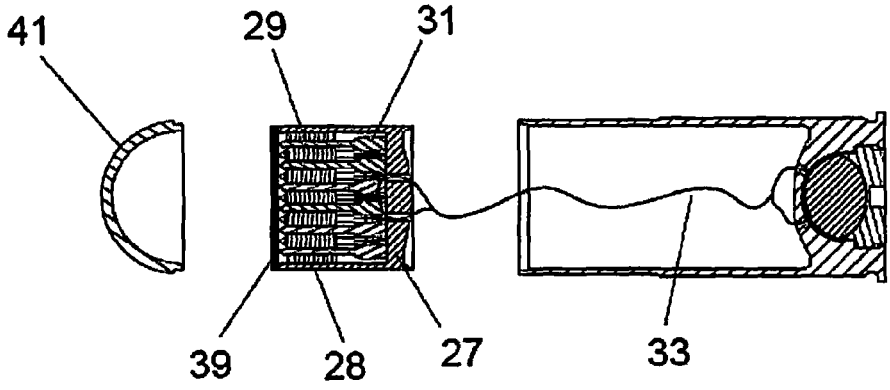
FIG. 5 is an exploded cross sectional view of the flechette cartridge of the present invention, illustrating the construction of the embodiment of the present invention comprising a sub caliber payload cup in attachment with the cartridge body via a tether, as illustrated in FIG. 3.
Figure 6:
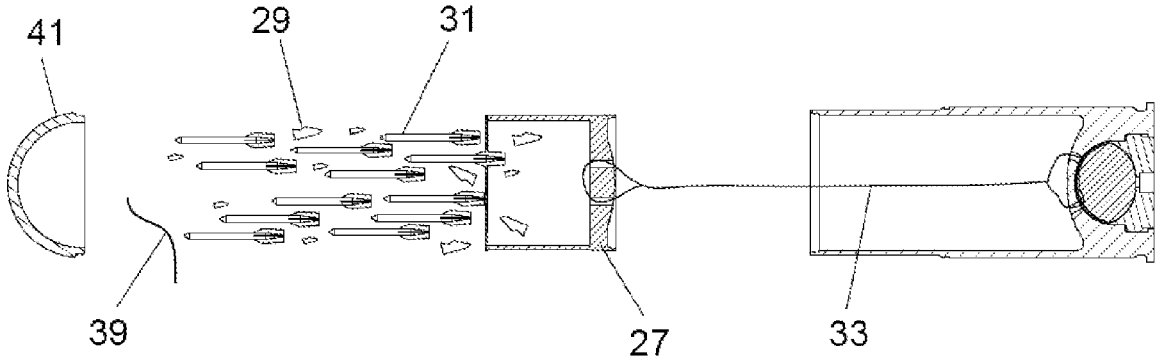
FIG. 6 is a cross sectional view of the flechette cartridge of the present invention, illustrating the tether acting upon the payload cup so as to allow the flechettes to continue forward travel free of the payload cup.

Preferably, the sub caliber payload cup 21 further comprises a payload cup stripping means 33, as illustrated in FIGS. 2-3 and 5-6. The payload cup stripping means 33, generally comprised of a string or line, as called for the in the fourth embodiment above, to attach the sub caliber payload cup 27 to the cartridge case 3, is in communication with the cartridge case 3 at a first end 35, and with the payload cup 21 at an end 37 (i.e., a second end) opposite the first end 35. As illustrated in FIG. 5 and FIG. 6, when the flechette cartridge 1 is fired, the payload cup 33 is propelled from the smooth bored cartridge barrel 15 and, at a predetermined distance from the smooth bored cartridge barrel 15 (which is dependent upon the length of the payload cup stripping means 33), the payload cup stripping means acts 33 upon the sub caliber payload cup 27 (by restraining same) to strip the flechette retaining means 29 from the flechettes 31, allowing only the flechettes 31 to continue direct forward travel. Thus, the sub caliber payload cup 27 is prevented from traveling with the flechettes 31 to the target.

The line or string is preferably designed to break near the attachment point inside the cartridge case 3 (i.e., at or adjacent to the first end 35), to eliminate having the string remaining in the barrel after firing. This is accomplished by creating a weak point, such as a knot, near attachment point of the line or string to the cartridge case 3. The process of breaking the string or line extracts sufficient kinetic energy from the flechette payload cup 33 to reliably strip the payload cup 33 from the flechettes 31.

Figure 3:
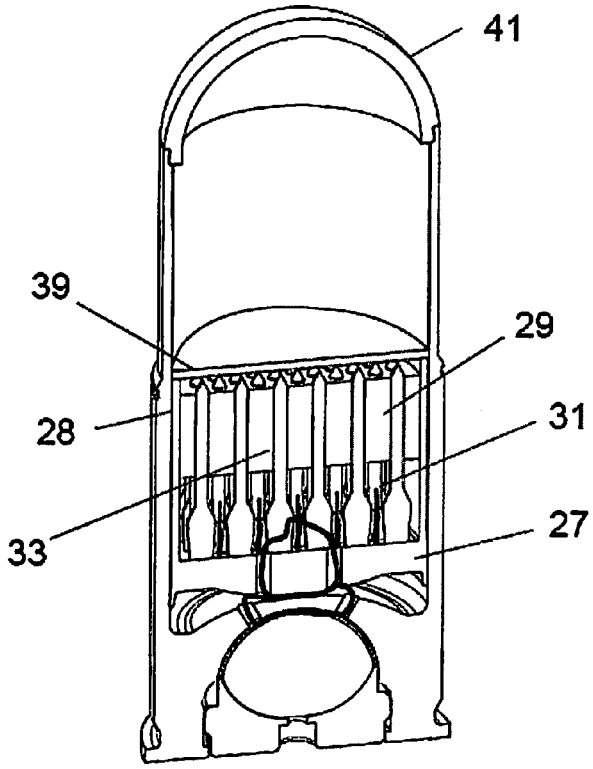
FIG. 3 is a partially cut away perspective view of the flechette cartridge of the present invention, having a sub caliber payload cup disposed therein.

As illustrated in FIG. 3, the flechette cartridge 1 may further comprise an ogive cap 41, removably disposed on the cartridge case 3 adjacent the open mouth 17 of the smooth-bored cartridge barrel 15. This ogive cap 41 merely prevents intrusion of foreign objects and/or moisture from entering the barrel 15 prior to firing. The ogive cap 41 is forcibly ejected from the cartridge case 3 during firing, and expelled from the weapon barrel.

As illustrated in FIG. 1 and FIG. 2, when the flechette cartridge 1 does not include an ogive cap 41, means for protecting the sub caliber payload are needed. Accordingly, the flechette cartridge 1 may further comprise a closure disk 51, as illustrated in FIG. 1, disposed within the smooth-bored cartridge barrel 15, adjacent the flechettes 31 and the flechette retaining means 29 of the sub caliber payload cup 27. This closure disk 51 performs essentially the same task as the ogive cap 41, i.e., prevents intrusion of foreign objects and/or moisture from damaging the payload.

As illustrated in FIG. 1, in a preferable embodiment, the flechette cartridge 1 preferably comprises an empty volume equaling or exceeding the volume of the payload cup is present within the smooth-bored cartridge barrel 15 between the sub caliber payload cup 21 and the open mouth 17 of the smooth-bored cartridge barrel 15. This empty volume within the smooth-bored cartridge barrel 15 acts as an internal cartridge barrel, to launch the payload, rather than utilizing the weapon barrel (which can be damaged by the flechette payload and/or cause a decrease in accuracy thereof). Longer cartridge barrel lengths allow for gentler payload accelerations, with lower required peak propellant pressures.

Figure 4:
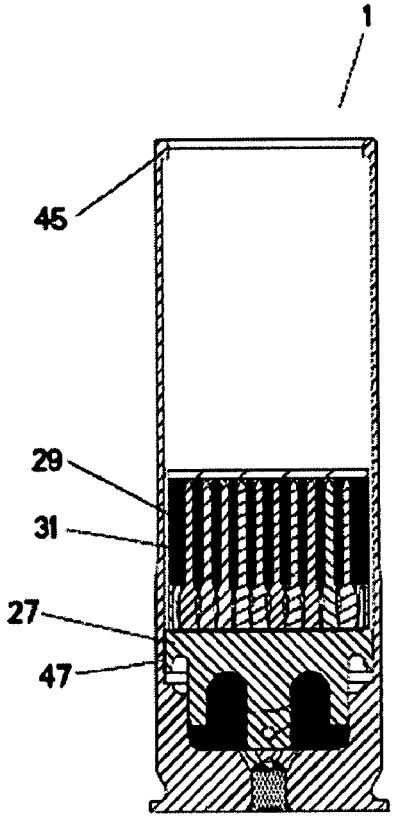
FIG. 4 is a cross sectional view of the flechette cartridge, illustrating the frictional payload cup stripping means.

In a preferred embodiment, as illustrated in FIG. 4, in order to decelerate the payload cup upon firing, a barrel ridge 45 is formed on the smooth-bored cartridge barrel 15. In addition, a payload cup ridge 47 is formed on the sub caliber payload cup 27 adjacent the base thereof. When the sub caliber payload cup 27 is fired, the payload cup 27 travels down the cartridge barrel 15. At a certain point, the payload cup ridge 47 impacts the barrel ridge 45. This impact produces a negative effect on the acceleration of the payload cup 27, causing deceleration thereof.

Although specific embodiments of the present invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A flechette cartridge comprising:

(a) a cartridge case having:

(i) a base; and (ii) a cartridge case body having an outer circumference adjacent the base, and an inner circumference opposite the outer circumference, said inner circumference defining a smooth-bored cartridge barrel, the smooth-bored barrel having a open mouth at one end thereof; and (b) a sub caliber payload cup slidably disposed within the smooth-bored cartridge barrel, the sub caliber payload cup having:

(i) a payload cup body having an outer base, an outer circumference adjacent the outer base, an inner circumference opposite the outer circumference, and an inner base opposite the outer base; and (ii) a flechette retainer for retaining flechettes, disposed within the inner circumference; and (iii) a plurality of flechettes retained within the flechette retaining means; and (c) a tether in communication with the cartridge case at a first end, and with the payload cup adjacent an end opposite the first end, wherein, when the flechette cartridge is fired, the subcaliber payload is propelled from the smooth bored cartridge barrel and, at a predetermined distance from the smooth bored cartridge barrel, the tether acts upon the subcaliber payload cup to strip the payload cup from the flechettes, and allow only the flechettes to continue direct forward travel.

2. The flechette cartridge of claim 1, wherein the payload cup body further comprises a metal disk disposed therein, within the inner circumference of the payload cup body, adjacent the inner base.

3. The flechette cartridge of claim 1, wherein a barrel ridge is formed on the smooth-bored cartridge barrel, and a payload cup ridge is formed on the payload cup, adjacent the outer base thereof.

4. The flechette cartridge of claim 1, further comprising an ogive cap removably disposed on the cartridge case adjacent the open mouth of the smooth bored barrel.

5. The flechette cartridge of claim 1, further comprising a metal disk disposed within the cartridge barrel between a low pressure chamber disposed within the cartridge case and the payload.

6. The flechette cartridge of claim 1, wherein an empty volume is present within the cartridge barrel between the payload cup and the open mouth of the smooth-bored barrel.

7. The flechette cartridge of claim 1, further comprising a closure disk disposed within the cartridge barrel, adjacent the flechettes and flechette retaining means of the sub caliber payload cup.

* * * * *